US009180469B2

(12) United States Patent
Nolte et al.

(10) Patent No.: US 9,180,469 B2
(45) Date of Patent: Nov. 10, 2015

(54) ROTARY ATOMIZER AND METHOD FOR THE CONTROL OF THE SPRAYING BODY OF SAID ROTARY ATOMIZER

(75) Inventors: Hans-Jurgen Nolte, Besigheim (DE); Harald Gummlich, Ludwigsburg (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 240 days.

(21) Appl. No.: 13/498,212

(22) PCT Filed: Sep. 21, 2010

(86) PCT No.: PCT/EP2010/005775
§ 371 (c)(1), (2), (4) Date: Mar. 26, 2012

(87) PCT Pub. No.: WO2011/035887
PCT Pub. Date: Mar. 31, 2011

(65) Prior Publication Data

US 2012/0180722 A1 Jul. 19, 2012

(30) Foreign Application Priority Data

Sep. 24, 2009 (DE) ..... 10 2009 042 956

(51) Int. Cl.

| | |
|---|---|
| ***B05B 3/10*** | (2006.01) |
| ***B05B 3/02*** | (2006.01) |
| ***B05B 5/04*** | (2006.01) |
| *B05B 7/08* | (2006.01) |

(Continued)

(52) U.S. Cl.

CPC ..... *B05B 3/1042* (2013.01); *B05B 3/1035* (2013.01); *B05B 3/1064* (2013.01); *B05B 3/1085* (2013.01); *B05B 5/0415* (2013.01); *B05B 5/0422* (2013.01); *B05B 3/1014* (2013.01); *B05B 3/1092* (2013.01); *B05B 5/0407* (2013.01); *B05B 7/0815* (2013.01); *B05B 13/0431* (2013.01); *B05B 13/0452* (2013.01); *B05B 15/12* (2013.01)

(58) Field of Classification Search

None

See application file for complete search history.

(56) References Cited

U.S. PATENT DOCUMENTS

| | | | | |
|---|---|---|---|---|
| 3,754,471 | A | 8/1973 | Hohenberg | |
| 4,795,095 | A * | 1/1989 | Shepard | 239/214.17 |

(Continued)

FOREIGN PATENT DOCUMENTS

| | | |
|---|---|---|
| DE | 4306799 A1 | 9/1994 |
| DE | 69300254 T2 | 11/1995 |

(Continued)

OTHER PUBLICATIONS

International Search Report, PCT/EP2010/005775, filed Jan. 28, 2011.

*Primary Examiner* — Dah-Wei D Yuan
*Assistant Examiner* — Binu Thomas
(74) *Attorney, Agent, or Firm* — Bejin Bieneman PLC

(57) ABSTRACT

Exemplary illustrations of a bell cup for a rotary atomizer and method of using the same are disclosed. The exemplary illustrations are generally directed to the control of the rotating bell plate of a rotary atomizer used for the serial coating of work pieces. An air flow component may be created by the structural design of the bell plate and/or of an element of the rotary atomizer and by the rotation of the bell plate. The air flow component may correspond to the bell plate design, and the element may be adjacent to the bell plate and stationary relative to same. The air flow component may be measured and compared to a predefined reference value.

13 Claims, 2 Drawing Sheets

(51) Int. Cl.
*B05B 13/04* (2006.01)
*B05B 15/12* (2006.01)

(56) References Cited

U.S. PATENT DOCUMENTS

| | | | | | |
|---|---|---|---|---|---|
| 5,685,495 | A | * | 11/1997 | Pham et al. | 239/588 |
| 5,697,559 | A | * | 12/1997 | Davis et al. | 239/703 |
| 5,707,009 | A | * | 1/1998 | Schneider | 239/112 |
| 5,727,735 | A | * | 3/1998 | Baumann et al. | 239/112 |
| 6,053,428 | A | * | 4/2000 | Van Der Steur | 239/290 |
| 2005/0098102 | A1 | * | 5/2005 | Baumann | 118/712 |
| 2005/0181142 | A1 | * | 8/2005 | Hirano et al. | 427/421.1 |
| 2007/0090204 | A1 | * | 4/2007 | Nolte et al. | 239/225.1 |
| 2008/0164342 | A1 | * | 7/2008 | Ballu et al. | 239/223 |
| 2011/0000974 | A1 | * | 1/2011 | Nolte et al. | 239/3 |

FOREIGN PATENT DOCUMENTS

| | | | |
|---|---|---|---|
| DE | 69306975 | T2 | 7/1997 |
| DE | 102005015604 | A1 | 10/2006 |
| DE | 102006057596 | A1 | 6/2008 |
| DE | 102007062132 | A1 | 7/2009 |
| EP | 0715896 | A2 | 6/1996 |
| EP | 1266695 | A1 | 12/2002 |
| EP | 1394757 | A2 | 3/2004 |
| EP | 1674161 | A2 | 6/2006 |
| EP | 1789200 | A1 | 5/2007 |
| EP | 1955776 | A1 | 8/2008 |
| FR | 2360351 | A1 | 3/1978 |
| FR | 2374963 | A2 | 7/1978 |
| JP | H8-5803416 | A | 4/1996 |
| JP | H8-332415 | | 12/1996 |
| JP | 2009045518 | | 3/2009 |

* cited by examiner

ROTARY ATOMIZER AND METHOD FOR THE CONTROL OF THE SPRAYING BODY OF SAID ROTARY ATOMIZER

CROSS-REFERENCES TO RELATED APPLICATIONS

This application is a National Stage application which claims the benefit of International Application No. PCT/EP2010/005775 filed Sep. 21, 2010, which claims priority based on German Application No. DE 10 2009 042 956.5, filed Sep. 24, 2009, both of which are hereby incorporated by reference in their entireties.

BACKGROUND

The present disclosure relates to a method for monitoring the rotating spray body of a rotary atomizer, e.g., the fixing of the spray body, as well as a corresponding rotary atomizer according to the preamble of the independent patent claims. Rotary atomizers of this type may be used for conventionally electrostatic series coating of workpieces such as vehicle bodies, and are conventionally mounted on painting robots or similar automatic coating machines.

Some known bell cups, which serve as spray bodies, of the electrostatic rotary atomizers (for example, as described in DE 43 06 799 and corresponding U.S. Pat. No. 5,727,735, EP 0 715 896 and corresponding U.S. Pat. No. 5,707,009, DE 10 2005 015 604 and corresponding U.S. Pat. Pub. Nos. 2006/0219816 and 2010/0143599, and DE 10 2006 057 596 and corresponding U.S. Pat. Pub. No. 2011/0000974) are employed in an automatic series coating of workpieces and may have a cylindrical hub member provided with an external thread, which hub member is screwed into the open end face of the hollow shaft of the drive motor consisting of an air turbine and can for example be unscrewed for maintenance purposes or for replacement with a new bell cup. Due to the high rotational speeds of the air turbine, e.g., in the range of more than 50,000 rpm, a precise centering and balancing of the bell cup in relation to the hollow shaft axis is important for this fixing apparatus. Accordingly, the hub member of the bell cup may have a conical part which bears against a correspondingly conical region of the internal wall of the hollow shaft for forming a centering cone. In the case of other known rotary atomizers (EP 1 266 695 and corresponding U.S. Pat. Nos. 6,811,094 and 6,988,673), by contrast, the hub member of the bell cup may have an internal thread, using which it is screwed onto an external thread at the end of the hollow shaft.

In addition to the centering and balancing, the apparatuses for fixing a bell cup on the drive shaft thereof must satisfy further conditions, such as a secure seat for reliable transmission of torques in both rotational directions when accelerating or braking, low space requirement, low risk of contamination, e.g. by paint mist and simple cleaning, as well as not least the option of fast and simple mounting and demounting.

In the case of the known rotary atomizers, the problem exists that the releasable fixing apparatus can unintentionally come loose itself in the event of faults. Such faults may have different causes, such as e.g. wear of the turbine, damage due to collision of the bell cup with the workpiece to be coated or due to improper handling, unbalancing of the bell cup due to damage, due to incorrect screwing on or due to contamination etc. and in each case can lead to a sudden sharp braking or locking of the shaft. The risk of an unintentional loosening of the bell cup can, in the case of a bell cup which is screwed on or in, also arise in the case of strong acceleration or deceleration of the bell cup, depending on the thread direction (right or left). In any case, the bell cup rotating at high rotational speed and unscrewing itself due to its kinetic energy can be spun off from the atomizer with the consequence of considerable mechanical damage and accident risks.

Various constructional options for preventing the spinning off of the bell cup are described in EP 1 674 161. Above all in the case of complete automation of the coating operation, they are not sufficient however, as although the mechanical damage and accident risks mentioned are prevented, coating errors due to the bell cup disengaging from the correct position during the production process cannot be excluded. Typical malfunctions of atomizers are, for example, an unstable spray jet or interruption of the atomization with the consequence of workpieces which are defective, as they have not been coated flawlessly.

Methods known from the generic prior art for the monitoring of the presence or fixing of components use electrical sensors and/or optical components. Due to the high voltage at electrostatic atomizers with the necessity of insulation measures connected therewith, electrical connections and electrical components in atomizers are not used for the purpose considered here, however, and due to the generation of paint aerosols by means of the atomizer, optical components for fixing monitoring are also unsuitable on account of the contamination sensitivity thereof.

A pneumatic system for monitoring the presence or the determination of an incorrect fixing of the bell cup of a rotary atomizer, which is fixed on the drive shaft by means of axial magnetic force, is known from EP 1 789 200 and corresponding U.S. Pat. No. 7,770,826. The drive shaft has an axial compression bearing in which an air cushion counteracting the magnetic force is generated by an own compressed air source thereof, the pressure of which air cushion is monitored using a sensor. Various problems arise in practice with this system, such as, e.g., the necessity of the special compressed air source, which additionally must be regulated precisely to prevent measurement errors and in the event of overpressure can loosen the magnet fixing. Also difficult is a precise and error-free pneumatic signal transmission from the axial compression bearing to the sensor, wherein functional faults due to blocking of the sensor channel or bending of the air hose are possible. Further, the compressed air flowing out of the bearing can impair atomizer functions such as the brush size for example. Incidentally, no rotation detection takes place in the known systems either.

Accordingly, there is a need for an improved bell cup and/or method of using the same which inhibits or prevents malfunctions of rotary atomizers, including corresponding coating errors, caused by the bell cup, particularly in the case of the loosening of the fixing thereof, without the disadvantages of the known systems.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
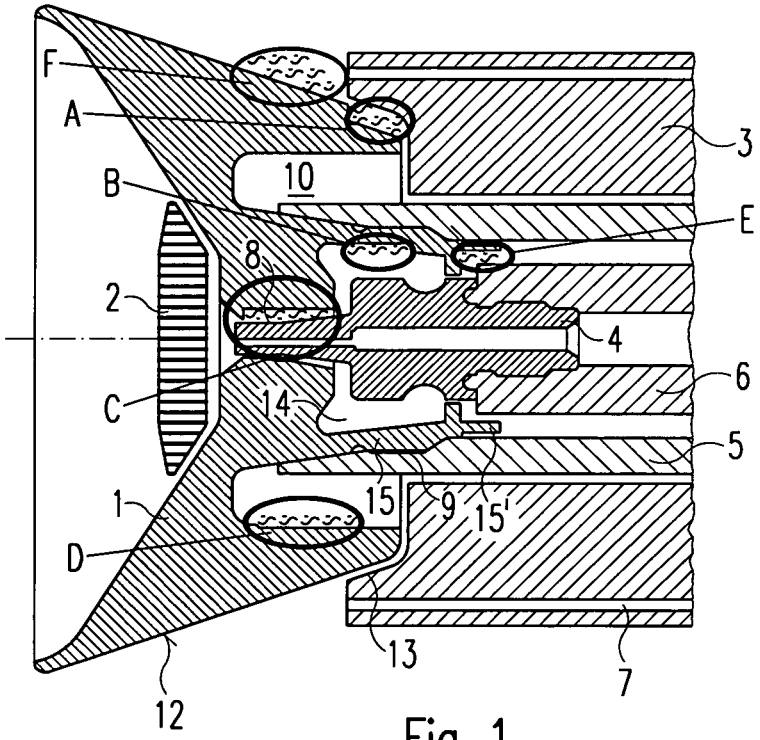
FIG. 1 illustrates a part of a rotary atomizer, according to an exemplary illustration.

The exemplary illustrations are generally based on the insight that an undesired loosening of the rotating bell cup or other spray body of the rotary atomizer can simply and reliably be determined if active flow constructional elements are provided on the spray body and/or on a fixed component located oppositely or adjacently thereto, with which constructional elements a definable local air flow is only generated in the case of rotary operation, which air flow changes in the event of the loosening of the spray body and can be located inside or outside of the drive shaft and can be monitored with a sensor. One is therefore concerned here with one or a plurality of flow components which are generated or caused only by or as a consequence of the rotation of the spray body.

If one provides different active flow constructional elements for various rotary atomizers and/or spray bodies or bell cups, the option furthermore arises by way of the exemplary illustrations, of determining the respective type of the rotating bell cup and consequently to exchange an incorrect bell cup by comparing the measurement results with reference values. In practice, it may be important for ensuring the function quality that only bell cups of a certain prescribed type may be used for a given rotary atomizer, and thus it may be desirable to minimize or eliminate risks of mixing up the bell cup types. In accordance with this aspect, the exemplary illustrations therefore provide for a reliable way of detecting a bell cup type or configuration.

The bell cup itself may have at least one active flow constructional design.

According to the one exemplary illustration, one or also a plurality of flow components can be generated and measured. The active flow constructional elements may be additional elements not already provided for other reasons, but the use of elements already present for other reasons for the generation and measurement of defined flow components is also possible.

Flow or pressure sensors can, for example, be used as sensor. Another possibility consists e.g. in detecting special sound waves or sound patterns caused by the active flow elements and if appropriate by special pressure fluctuations, which may in particular be expedient for the above-mentioned differentiation of different bell cup types.

The active flow elements can be located inside or outside of the drive shaft and directly generate a defined flow component or also cause a defined pressure-equalizing air flow.

According to one aspect of the exemplary illustrations, the air friction at the outer surface of the rotating bell cup may be used in connection with the centrifugal force in order, by means of defined air flows, particularly dependent on the position of the bell cup and if appropriate with position-dependent pressure equalization, to monitor the intended position and/or shape or construction of the components and to detect fault situations.

Flow-generating elements can, in some examples, be integrated into the design of the bell cup and generate a local air flow in connection with stationary parts of the rotary atomizer or with the ambient air. The air flow signals can be guided by means of suitable existing or additional air guides to the sensor and therefore monitored during the rotation.

All active flow variants, such as wings, helical, spiral or thread-like shapes as well as leaf-shaped, spoon-like, fin-like and undulatory shapes can be used as flow-generating design elements. Bores or other active flow hollow shapes, structures or depressions are also possible.

Defined air flows or local pressure changes, which can be evaluated by means of measurement technology, can also be generated by friction-influencing surface coatings or macro-structures.

The active flow constructional elements can be realised at different sections of the outer and inner surface of the bell cup, such as e.g. in the open surroundings of the bell cup, on the bell cup opposite the directing air ring of the atomizer, on the bell cup opposite the paint nozzle, on the bell cup opposite the paint pipe, on the inner surface of the bell cup or on other structural parts.

If the generated or pressure-equalizing air flow depends on the mutual position, that is to say e.g. on a gap dimension between the adjacent rotating and fixed surfaces, the respective position of the spray head relatively to the fixed component of the rotary atomizer can be determined precisely from the measured flow component. If the comparison of the measured value with a predetermined reference value results in an incorrect position, if appropriate outside of a permissible tolerance range, suitable measures can be introduced automatically immediately.

It may be particularly expedient to provide the active flow elements on at least approximately or at least somewhat conical surfaces which are concentric to the rotational axis, such as e.g. on a conical outer curved surface of the bell cup. The active flow constructional elements can however also for example be located between an inner surface of the bell cup and the central pipe and nozzle body which in typical rotary atomizers extends into the bell cup.

The exemplary illustrations can be realised with or without screw fixings of the bell cup on the drive shaft, e.g., as with previous rotary atomizers. These screw connections have advantages, for example compared to a magnetic fixing, as the magnetic forces can damage the air turbine which is conventional as drive motor. Also, additional constructional safety measures for preventing the spinning off of the bell cup, in particular according to EP 1 674 161, which has been mentioned, can be retained. On the other hand, such additional safety measures may be superfluous under certain circumstances, as, on the basis of the exemplary illustrations, even the start of a loosening of the bell cup can be determined and the atomizer can be stopped automatically immediately, but in a low-acceleration manner, that is to say not too suddenly, before the bell cup can be loosened completely.

At the same time as the measures automatically introduced in the case of a fault state, for example for interrupting a coating process, the fault state can be indicated by means of a fault signal.

In addition to the already mentioned advantages, further important advantages result due to the exemplary illustrations. For example, the exemplary illustrations do not require any additional air supply for example or the control and precise regulation thereof or the operative and control outlay connected therewith. As no additional air has to be supplied from an external source, a fault of the atomizing function due to escaping test air is also excluded. Further, the flow component generated, according to the exemplary illustrations, can be measured without any problems, as e.g. a transmission of the flow pressure can be guided through the paint pipe present in a typical rotary atomizer or through the drive shaft or between the drive shaft and the turbine stator to the sensor. A further important advantage is the possibility of a self-control of the system, as in the case of rotating bell cup, a completely different measured value must result than in the case of standstill. Control errors, for example due to air guides which are blocked or interrupted in another manner, which could be interpreted as correct fixing, are therefore not possible.

For example, compared to electrical measurement methods, the exemplary illustrations incidentally have the advantage that the system is not sensitive to the high voltage of a rotary atomizer, as the air pressure and the flow components can be guided over the distance necessary for high-voltage insulation through channels or lines made of insulating material into regions which are at low potential and can only there be converted into electrical signals for example. Compared to optical measurement methods, the exemplary illustrations have the advantage of not being sensitive to contamination for example by means of paint mist, which can impair the function of optical components.

As has already been mentioned at the beginning, the rotary atomizer described here can e.g. be mounted in any manner that is convenient, e.g., the conventional manner on the wrist of a coating robot or on another automatic coating machine.

The front part of an exemplary rotary atomizer facing the workpiece to be coated is shown in a schematically simplified manner in FIG. 1. A bell cup 1 with the usual paint distribution disc 2 is shown with a directing air ring 3 with an annular arrangement of directing air bores 7, the central paint supply pipe 6 with the paint discharge nozzle 4 extending into the central centre bore 8 of the bell cup and the drive shaft 5 constructed as a hollow shaft, into the open end of which, which according to the representation is conical at the front end, the bell cup is screwed. According to the representation, the corresponding conical hub member of the bell cup fits into the conical part of the drive shaft 5. The thread for tightening the bell cup is located at 9 on the cylindrical surfaces of the bell cup or the drive shaft. At 10, the bell cup, among other things for the purposes of rinsing, has an internal annular space which extends from the rear of the bell cup axially into the body thereof. All of the above-mentioned parts may be rotationally symmetrical and concentric to the rotational axis. In the case of high-rotation atomizers of the type considered here, the bell cup 1 typically rotates at rotational speeds between 15000 and 60000 rpm. In this respect, the rotary atomizer can correspond to, for example, EP 0 715 896 B1 (and corresponding U.S. Pat. No. 5,707,009), DE 10 2005 015 604 A1 (and corresponding U.S. Pat. Pub. Nos. 2006/0219816 and 2010/0143599), or DE 10 2006 057 596 A1 (and corresponding U.S. Pat. Pub. No. 2011/0000974), so that no further explanations are necessary.

According to one exemplary illustration, the bell cup 1 has the integrated flow-generating elements, which are only indicated schematically at various points A-F and are missing in the case of the known bell cups, however. At least to the extent that they are integrated into the bell cup, these elements also may be arranged rotationally symmetrically and concentrically to the rotational axis in such a manner that no unbalancing of the bell cup is caused. According to the representation, elements of this type can for example be provided at one or a plurality of the following points:

At A in the region between the bell cup 1 and the directing air ring 3, in particular between the rear conical end part of the outer curved surface 12 of the bell cup and, in one exemplary illustration, at least approximately correspondingly conical inner surface 13 of the directing air ring 3, which lies adjacently opposite the same;

at B in the region of the internal space 14 of the hub member 15 of the bell cup, that is to say in particular between the inner side of the hub member and the external circumference of the part of the paint discharge nozzle 4 located in the internal space;

at C in the region of the centre bore 8 of the bell cup, that is to say between the circumference thereof and the external circumference of the end part of the paint discharge nozzle 4 extending into the centre bore;

at D in the region of the annular space 10 of the bell cup, e.g. according to the representation, between the radially external cylindrical surface of the annular space 10 and the external circumference of the end part of the drive shaft 5 extending into the annular space, wherein it is to be taken into account that the annular space 10 can substantially be closed at the inner end by the axial end face of the fixed directing air ring 3;

at E in the region of the rear, that is to say atomizer-side, end part of the hub member 15, i.e. for example according to the representation between the inner side of an annular hub end member 15' and the external circumference of the paint supply pipe 6, in the end of which the nozzle 4 sits;

and/or at F in the region between the conical outer curved surface 12 and the open surroundings outside of the rotary atomizer.

Figure 2:
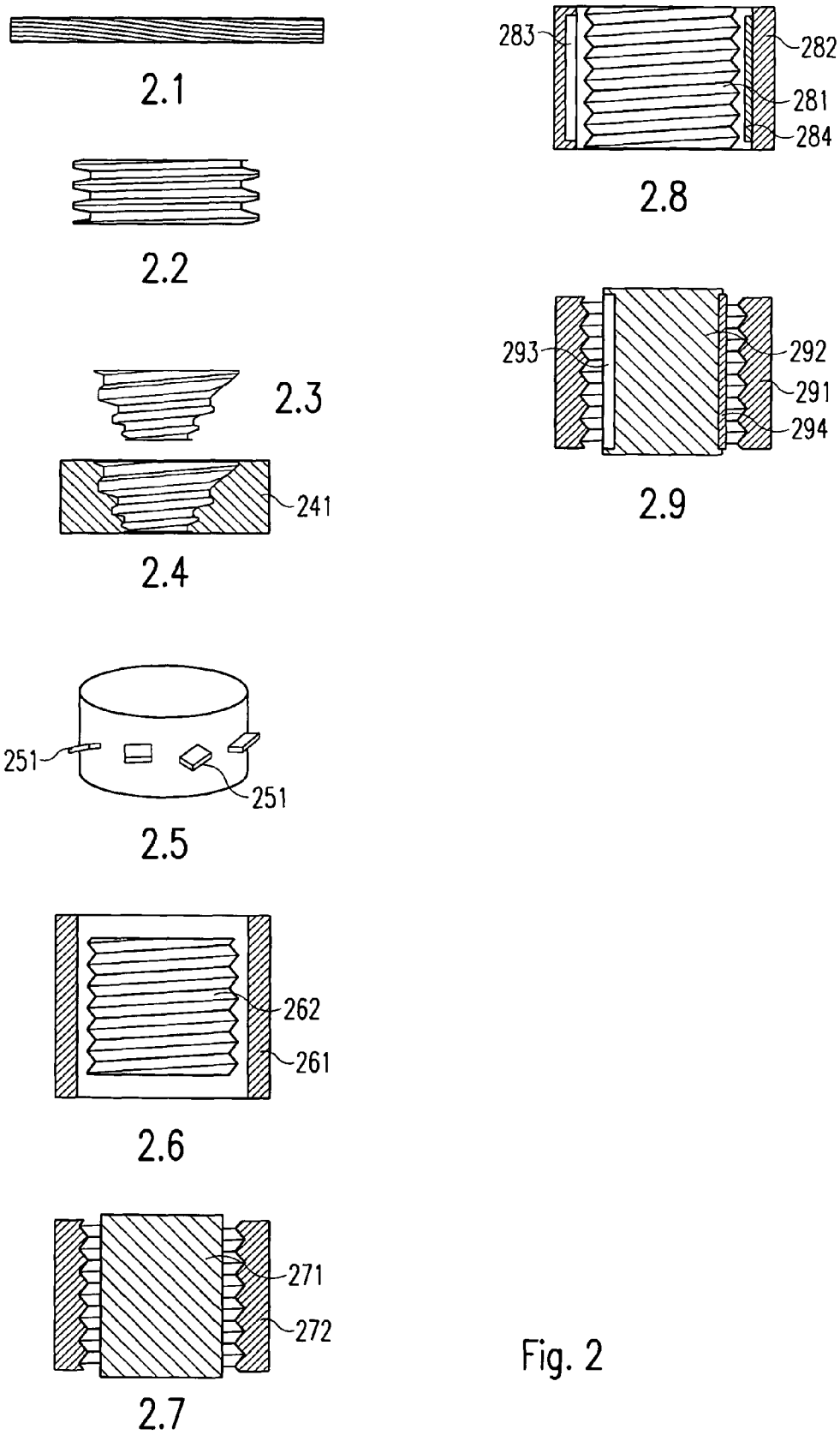
FIG. 2 illustration various exemplary illustrations of an active flow constructional element.

Various examples for flow-generating constructional elements suitable according to the exemplary illustrations are illustrated schematically in FIG. 2. Corresponding cylindrical or non-cylindrical inner or outer surfaces, which can be provided with the elements illustrated, are present at various points on the bell cup 1 and/or on the other illustrated components of the rotary atomizer.

The representation 2.1 for example shows rounded outer threads of a spirally structured cylindrical surface.

The representation 2.2 for example shows trapezoidal outer threads in a cylindrical surface.

The representation 2.3 shows outer threads on an essentially conical component.

The representation 2.4 shows inner threads in the circumference of an essentially conical recess of a fixed or rotating component 241.

The representation 2.5 shows a cylindrical component which is provided on its circumference with wing-like elements 251 suitable for flow generation.

The representation 2.6 shows a thread structure which can in particular be provided on the cylindrical outer side of an inner part 262 rotating in a fixed cylindrical outer part 261.

The representation 2.7 shows a thread structure which can in particular be provided on the cylindrical inner surface of an outer part 272 rotating about a fixed cylindrical inner part 271.

The representation 2.8 shows a thread structure which can in particular be provided on the cylindrical outer surface of a fixed inner part 281 of the rotary atomizer. The thread structure interacts in this exemplary illustration with an active flow structure on the cylindrical inner side of a rotating outer part 282, which for example can be formed in accordance with the representation by means of axial longitudinal grooves 283 worked into the cylindrical inner surface of the rotating bell cup part 282 and/or by axial longitudinal webs 284 projecting from the inner surface.

The representation 2.9 shows a thread structure which can in particular be provided on the cylindrical inner surface of a fixed outer part 291 of the rotary atomizer. The thread structure interacts in this exemplary illustration with an active flow structure on the cylindrical outer side of a rotating inner part 292, which for example can be formed in accordance with the representation by means of axial longitudinal grooves 293 worked into the cylindrical outer surface of the bell cup part 292 and/or by axial longitudinal webs 294 projecting from the outer surface.

Combinations and modifications of the exemplary illustrations shown in FIG. 2 are also possible; for example, instead of the cylindrical surfaces shown in each case, more or less conical surfaces can be used.

Figure 3:
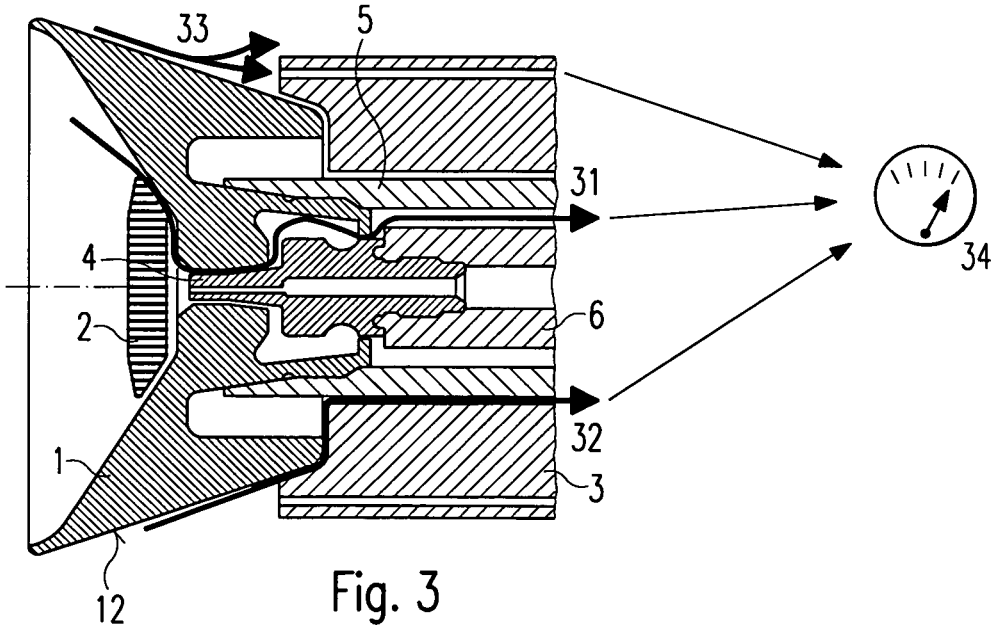
FIG. 3 various exemplary flow components which can be generated and evaluated in accordance with the exemplary illustrations.

FIG. 3 schematically shows various flow components which can be generated according to the exemplary illustrations. According to a first exemplary illustration, the path of the flow component represented at 31 runs between the bell cup 1 and the paint discharge nozzle 4, specifically in particular, according to the representation, from the front surroundings of the bell cup initially between the distribution disc 2 and the end face of the bell cup, then through the centre bore 8 (FIG. 1) between the inner wall of the bell cup there and the external circumference of the front end of the nozzle 4 located in the centre bore, then through the internal space 14 (FIG. 1) between the circumferential surface thereof and the external circumference of the nozzle 4 and from there through the cylindrical annular gap between the inner side of the drive shaft 5 constructed as hollow shaft and the external circumference of the paint supply pipe 6.

According to a second exemplary illustration, the path of the flow component represented at 32 runs between the bell cup 1 and the directing air ring 3, specifically in particular, according to the representation, from the surroundings of the outer curved surface 12 of the bell cup, along the same in the conical annular gap formed between the surface 12 and the inner surface 13 (FIG. 1) of the directing air ring and from there through the cylindrical annular gap between the external circumference of the drive shaft 5 and the cylindrical inner surface of the directing air ring 3.

A third exemplary illustration is the flow component 33, which first runs between the surroundings of the bell cup 1 and the outer curved surface 12. From there, the flow component 33 can then for example be guided along the cylindrical external circumference of the directing air ring 3 further into the rotary atomizer. The path of the flow component 33 can however also run through the directing air bores 7, e.g. if the directing air is switched off, whilst if the directing air is switched on, the changing thereof could be measured by means of the flow component 33.

The exemplary illustrations are not limited to the flow components illustrated. These can run on other paths and also in other directions, possibly also in the opposite direction. Both positive and negative flow components or pressure changes caused thereby can be measured.

The sensor 34 illustrated in FIG. 3, which can expediently be a flow sensor or back-pressure sensor or the like, can be used to measure the flow components generated or the corresponding pneumatic signals thereof. It may also be expedient to provide a plurality of sensors for measuring one or a plurality of different flow components or pneumatic signals corresponding thereto. The sensor 34 can for example be located in a rear part of the rotary atomizer which is not illustrated.

The transmission of the flow component to be measured to the sensor 34 may take place through the rotary atomizer. It may be particularly expedient if the pneumatic flow or pressure signal is guided through the paint supply pipe 6 or the drive shaft 5 to the sensor 34 in suitable hoses or lines.

If for example, a helical surface structure in accordance with the representation 2.3 in FIG. 2 is integrated into the conical outer curved surface 12 at A in FIG. 1, in the case of a rotating bell cup and suitably chosen direction of rotation, an air flow can be generated in the closed atomizer interior, which generates an overpressure there, e.g. in accordance with the flow component 32 in FIG. 3. This overpressure only arises in the case of rotation of the bell cup. The overpressure can for its part escape via the existing air gap between the bell cup and directing air ring into the surroundings. This means that the generated overpressure is dependent on the rotational speed and on the gap dimensions between the adjacent surfaces of the bell cup and directing air ring, i.e. on the current position and thus fixing of the bell cup. These pressure values can be detected and stored for defined situations in advance, so that during later use in production, a regular measurement of the current actual values and a comparison with the corresponding setpoint values is possible. In the event that the fixing (screw connection) of the bell cup has loosened, the position of the bell cup moves away relatively to the directing air ring. The higher gap dimension between the bell cup and directing air ring enables a higher pressure equalization between the higher internal pressure and the surroundings, i.e. the overpressure drops and a difference from the setpoint value is formed. If a permissible tolerance limit is exceeded, a fault situation can be recognised and indicated as a fault signal, and measures for hazard prevention or for quality assurance can be introduced.

The mentioned at least one sensor 34 for flow components can be arranged in the atomizer or also outside of the atomizer. Outside of the atomizer, it can for example be located in fixing elements or in components of the painting or coating robot on which the atomizer is mounted or in other parts such as e.g. supply apparatuses of the coating installation.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular. use of the singular articles such as "a," "the," "the," etc. should be read to recite one or more of the indicated elements unless a claim recites an explicit limitation to the contrary.

The invention claimed is:

1. Rotary atomizer for series coating of workpieces, comprising a spray body that is fixable on a rotatably mounted shaft that is drivably connected to a motor; and a plurality of components of the rotary atomizer adjacent to the spray body, each of the plurality of components being fixed relative to the spray body and selected from a group comprising:

an annular body fixed relatively to the spray body, a nozzle of the rotary atomizer that extends along a rotational axis of the rotary atomizer into an internal space of the spray body, an end part of the that extends into an axial bore of the spray body, an inner annular space of the spray body, and a pipe body of the rotary atomizer;

wherein at least one of the spray body and one of the plurality of components of the rotary atomizer are arranged to generate a plurality of air flow components at respective locations of the rotary atomizer, the locations including at least two of:

between an outer surface of the spray body and a surface facing the spray body of the annular body, wherein directing air channels are arranged to direct air onto at least one of the outer surface of the spray body and a spray jet generated by the rotary atomizer;

between an inner surface of the spray body and the nozzle;

between a surface of a central axial bore of the spray body and an outer side of the end part of the nozzle that extends into the axial bore;

between a surface of an inner annular space of the spray body, the surface extending from a rear of the spray body facing away from an end face axially into the spray body, and a surface of one of the plurality of components that is fixed relative to the spray body adjacent to the annular space;

between an inner surface of a hub center member of the spray body and an outer side of the pipe body, the pipe body extending into the hub member and being fixed relative the hub member; and in an area external to the rotary atomizer, bordered in part by an outer surface of the spray body and another surface of the spray body.

2. The rotary atomizer according to claim 1, wherein at least one of the plurality of components is arranged to be directed parallel to a direction from surroundings of the rotary atomizer at least one of to and into the rotary atomizer.

3. The rotary atomizer according to claim 1, wherein an element generating an air flow is provided on a surface of the spray body.

4. The rotary atomizer according to claim 1, wherein a gap is provided between the spray body and at least one of the plurality of components, the width or size of which changes relative to the annular body in the event of a change of axial position of the spray body.

5. The rotary atomizer according to claim 1, wherein one or both of two mutually facing surfaces of the spray body are coaxial to the rotational axis and are at least approximately conical.

6. The rotary atomizer according to claim 1, wherein at least one of the following elements is provided for generating flow at at least one of the spray body and at least one of the plurality of components:

a thread structure, a helical structure, a spiral structure, a undulatory structure, and a wing-like configuration.

7. The rotary atomizer according to claim 3, wherein the plurality of components are provided on an at least approximately conical surface.

8. The rotary atomizer according to claim 1, wherein the sensor is located in the rotary atomizer.

9. The rotary atomizer according to claim 3, wherein the plurality of components are provided on a cylindrical surface.

10. The rotary atomizer according to claim 1, wherein the at least one sensor measuring the air flow component measures at least one of air flow, pressure, and sound waves.

11. The rotary atomizer of claim 1, wherein at least one sensor measuring the air flow component is provided.

12. A bell cup of a rotary atomizer, the surface of which has a design according to claim 1.

13. A coating apparatus for the automatic series coating of workpieces with a rotary atomizer according to claim 11, wherein the sensor is located in one of the following positions:

in the rotary atomizer, outside of the atomizer, in a part of the coating robot on which the rotary atomizer is or can be mounted, or in another part of the coating apparatus.

* * * * *